United States Patent [19]

Arimura et al.

[11] 4,033,165

[45] July 5, 1977

[54] APPARATUS FOR CONTROLLING FLATNESS OF METAL SHEET DURING ROLLING

[75] Inventors: Toru Arimura; Fumio Fujita, both of Yokohama, Japan

[73] Assignee: Nippon Kokan Kabushiki Kaisha, Tokyo, Japan

[22] Filed: Mar. 15, 1976

[21] Appl. No.: 666,905

[30] Foreign Application Priority Data

Apr. 15, 1975 Japan ..... 50-44830

[52] U.S. Cl. ..... 72/205; 72/161; 72/234

[51] Int. Cl.[2] ..... B21B 15/00; B21B 39/08

[58] Field of Search ..... 72/205, 160, 9, 12, 72/10, 234, 161

[56] References Cited

UNITED STATES PATENTS

| | | | |
|---|---|---|---|
| 3,459,019 | 8/1969 | Stone | 72/12 |
| 3,782,152 | 1/1974 | Sabatini | 72/9 |

*Primary Examiner*—Milton S. Mehr
*Attorney, Agent, or Firm*—Flynn & Frishauf

[57] ABSTRACT

An apparatus for controlling the flatness of a metal sheet during rolling, which comprises two edge-rollers and a center-roller provided closely adjacent to opposite ones of the upper and the lower surfaces of a metal sheet during rolling substantially in the horizontal direction, at least at one of the entry and the exit sections of rolling mill rolls; said edge-rollers and/or said center-roller causing a change in the tension distribution of said metal sheet in the width direction, by imparting desired vertical displacement to a desired portion of said metal sheet, thereby increasing the draft at said portion of said metal sheet during rolling. An auxiliary-roller is provided, if necessary, in contact with at least one of the upper and the lower surfaces of said metal sheet over the entire width thereof, at least at one of the entry and the exit sections of said mill rolls, and at a location more distant from said mill rolls than said edge-rollers and said center-roller, with a view to effectively changing said tension distribution.

18 Claims, 23 Drawing Figures

APPARATUS FOR CONTROLLING FLATNESS OF METAL SHEET DURING ROLLING

FIELD OF THE INVENTION

The present invention relates to an apparatus for correcting a metal sheet, in particular a thin steel sheet, defective in flatness, during rolling through rolling mill rolls.

BACKGROUND OF THE INVENTION

A metal sheet, in particular a thin steel sheet, is usually produced by rolling a material through rolling mill rolls. In this case, the sheet during rolling is elongated in the rolling direction while being rolled into a sheet with a reduced thickness.

Said elongation of the sheet during rolling in the rolling direction depends upon the draft (i.e., [thickness at the roll entry — thickness at the roll exit]/thickness at the roll entry), and the distribution is determined by the thickness distribution in the width direction before rolling and the thickness distribution in the width direction after rolling. The above-mentioned thickness distribution in the width direction after rolling is influenced by deformation of rolling mill rolls such as (a) elastic deformation of the mill rolls, (b) thermal expansion of the mill rolls caused by the heat input from the sheet in rolling to the mill rolls, (c) wear of the mill rolls resulting from friction between the sheet during rolling and the mill rolls.

For such reasons, when the elongation of the sheet during rolling in the rolling direction is not uniform and there occur differences in said elongation in the width direction, compressive and tensile residual stresses are produced in the finished sheet in the rolling direction. More specifically, since a small thickness is obtained in the case of a large draft and a large thickness is obtained in the case of a small draft, compressive stresses remain in the part of the finished sheet with a small thickness and tensile stresses remain in the part of the finished sheet with a large thickness. When these residual stresses exceed a certain limit, the finished sheet undergoes deformation out of the original plane, resulting in a phenomenon called "buckling". This is generally called the defective flatness of finished sheet.

SUMMARY OF THE INVENTION

An object of the present invention is therefore to provide, during rolling of a metal sheet, in particular a thin steel sheet, through rolling mill rolls, an apparatus for controlling the flatness of said metal sheet during rolling, which is simple in design and easy to use, permitting automatic control of the flatness of the sheet during rolling in response to disturbances caused in said flatness during rolling.

A principal object of the present invention is to provide an apparatus for controlling the flatness of a metal sheet during rolling, which permits automatic control of the flatness of the sheet during rolling by imparting a desired change in the tension distribution in the width direction of said sheet during rolling.

In accordance with one of the features of the present invention, there is provided an apparatus for controlling the flatness of a metal sheet during rolling through rolling mill rolls, comprising: two edge-rollers provided at least at one of the entry and the exit sections of rolling mill rolls, said edge-rollers being located symmetrically in the width direction of a metal sheet during rolling substantially in the horizontal direction, respectively closely adjacent to and facing one of the upper and the lower surfaces of said metal sheet at the side edge portions thereof, and said edge-rollers causing a change in the tension distribution in the width direction of said metal sheet, by imparting a desired vertical displacement to the side edge portions of said metal sheet, thereby increasing the draft at said side edge portions of said metal sheet during rolling; and a center-roller provided at least at one of the entry and the exit sections of said rolling mill rolls, said center-roller being located between said two edge-rollers, closely adjacent to and facing the other of the upper and the lower surfaces of said metal sheet at the width center portion thereof, the axial direction of said center-roller being perpendicular to the rolling direction of said metal sheet and horizontal, said center-roller being vertically movable, and said center-roller causing a change in the tension distribution in the width direction of said metal sheet, by imparting a desired vertical displacement to the width center portion of said metal sheet, thereby increasing the draft at said width center portion of said metal sheet during rolling.

BRIEF DESCRIPTION OF THE DRAWINGS

FIGS. 1(*b*), 2(*b*) and 3(*b*) being respective sectional views of said finished sheets in the width direction; FIGS. 1(*c*), 2(*c*) and 3(*c*) being respective graphs which show the tension distribution of said finished sheets in the width direction; and FIGS. 1(*d*), 2(*d*) and 3(*d*) being respective graphs which show the thickness distribution of said finished sheets in the width direction;

DETAILED DESCRIPTION OF PREFERRED EMBODIMENTS

FIGS. 1 to 3 show the relation between the thickness distribution of a finished sheet in the width direction after rolling in the case of a uniform thickness before rolling and the state of defective flatness of the finished sheet, resulting from said thickness distribution. In these drawings, figures (*a*) are perspective views of a finished sheet with defective flatness; figures (*b*) are sectional views of said finished sheet in the width direction; figures (*c*) are graphs which show the tension distribution in said finished sheet in the width direction; and figures (*d*) are graphs which show the thickness distribution of said finished sheet in the width direction. The state of defective flatness as shown in FIG.

1(*a*) is called the center buckling; the state of defective flatness as shown in FIG. 2(*a*) is called the quarter buckling; and the state of defective flatness as shown in FIG. 3(*a*) is called the wavy edge. These states of defective flatness of finished sheet lead to troubles of apparatus in the subsequent processes and to a decreased quality of products.

With a view to precluding the occurrence of such defective flatness of finished sheet, the roll bending method has been proposed among others.

Figure 1A:
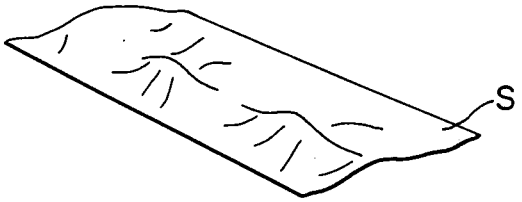
FIGS. 1(*a*)–1(*d*), 2(*a*)–2(*d*) and 3(*a*)–3(*d*) are schematic drawings of respective finished sheets with a defective flatness, FIGS. 1(*a*), 2(*a*) and 3(*a*) being perspective views of respective finished sheets with a defective flatness.
Figure 1B:
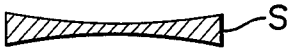
Figure 1C:
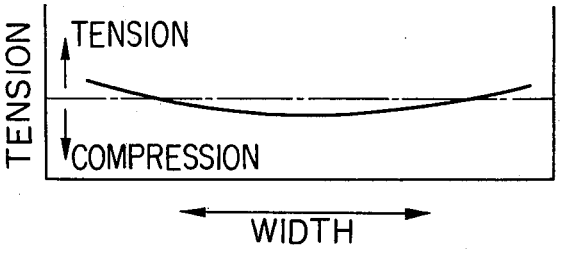
Figure 1D:
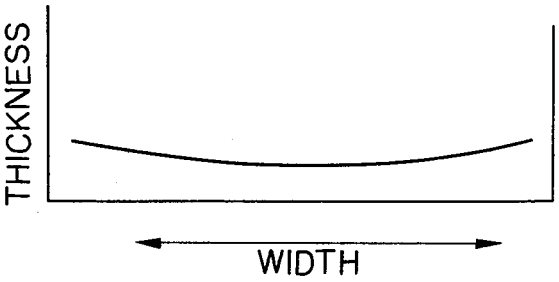
Figure 2A:
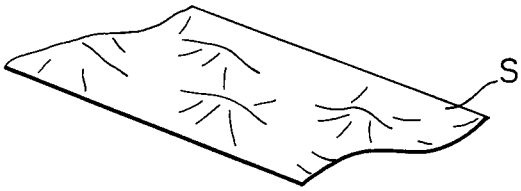
Figure 2B:
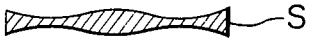
Figure 2C:
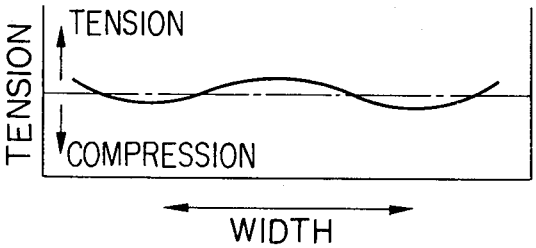
Figure 2D:
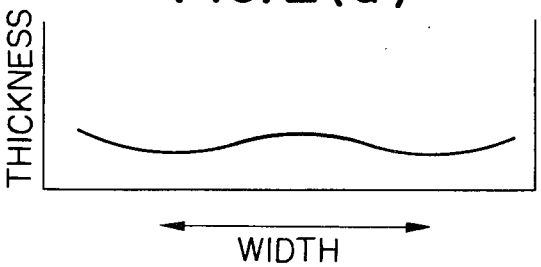
Figure 3A:
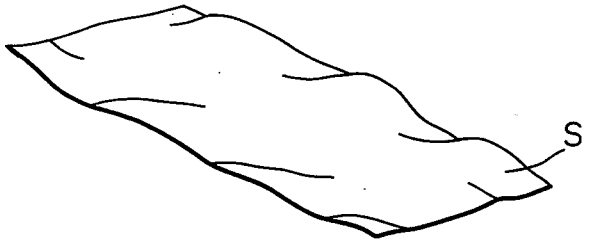
Figure 3B:
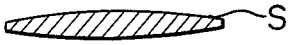
Figure 3C:
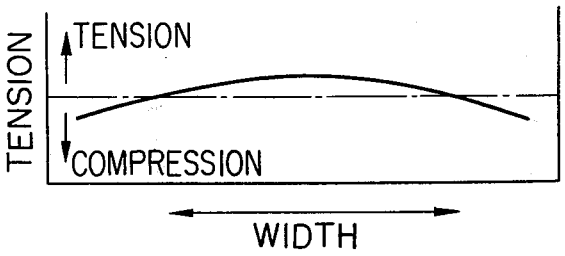
Figure 3D:
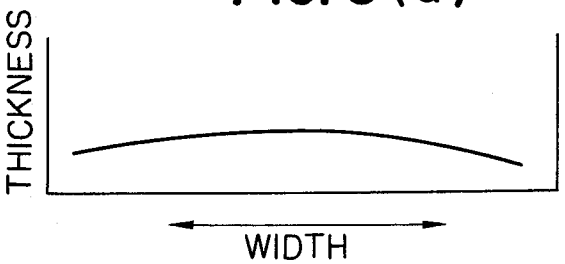
Figure 4:
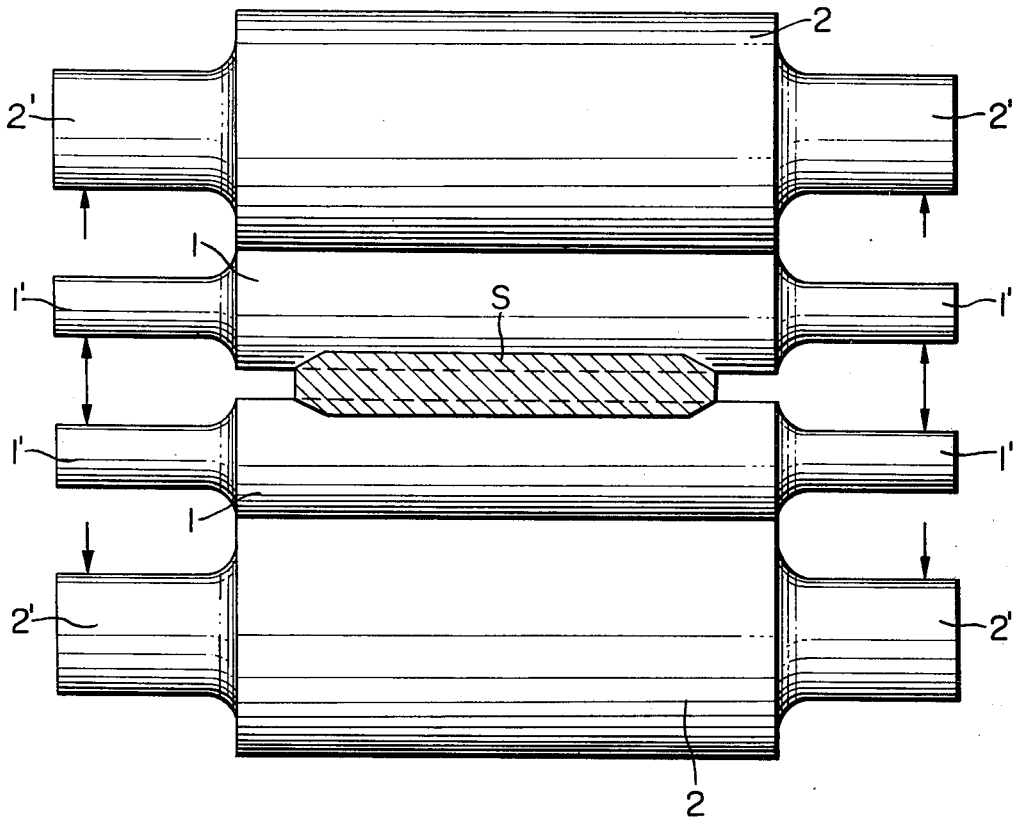
FIG. 4 PRIOR ART
FIG. 4 is a schematic drawing illustrating the conventional method for precluding the occurrence of a finished sheet with a defective flatness.

The roll bending method is a method for correcting a sheet S defective in flatness in rolling over the entire width, which comprises, as shown in FIG. 4, providing the respective roll neck ends 1′ and 2′ of work rolls 1 and back-up rolls 2 with pressure applying devices such as hydraulic cylinders (indicated by the arrows) and giving forced bending to said work rolls 1 and/or said back-up rolls 2, thereby changing the roll profiles. However, with the size of roll diameter getting larger, it becomes difficult to bend said work rolls 1 and said back-up rolls 2, and in particular, considerably large pressure applying devices (i.e., bending devices) are required for said back-up rolls 2 which have a larger roll diameter. In addition, when only said work rolls 1 are bent, the bending effect is limited to the edge portions of the sheet in rolling. This method is not therefore effective in precluding the occurrence of center buckling.

According to Dr. D. R. Bland and Dr. H. Ford, the following equations stand with regard to the rolling of a metal sheet through rolling mill rolls:

$$P = R' \int_{o}^{\phi} P^{+} d\theta + R' \int_{\phi}^{\alpha} P^{-} d\theta$$

$$P^{+} = k_m \left(1 - \frac{q_f}{k_m}\right) \frac{h}{h_2} e^{\mu H}$$

$$P^{-} = k_m \left(1 - \frac{q_b}{k_m}\right) \frac{h}{h_1} e^{\mu (H_1 - H)}$$

where, $P$: Rolling load, $P^{+}$: Rolling pressure acting on the part from the neutral point to the roll bite exit (The neutral point is defined as the point where the roll peripheral speed corresponds to the forward speed of the sheet in rolling. The roll bite is the contact surface between the rolls and the sheet in rolling.), $P^{-}$: Rolling pressure acting on the part from the neutral point to the roll bite entry, $k_m$: Mean deformation resistance of the sheet in rolling, $q_f$: Front tension applied to the sheet in rolling (i.e., the tension on the roll exit side), $q_b$: Back tension applied to the sheet in rolling (i.e., the tension on the roll entry side), $h$: Thickness of the sheet in rolling at an arbitrary point within the roll bite, $h_1$: Thickness of the sheet in rolling at the roll entry, $h_2$: Thickness of the sheet in rolling at the roll exit, $\theta$: Roll center angle comprising the part of the roll bite between the bite exit and the position corresponding to thickness $h$, $\phi$: Roll center angle comprising the part of the roll bite between the neutral point and the bite exit, $\alpha$: Roll center angle comprising the part of the roll bite between the bite entry and the bite exit, $R'$: Radius of the roll as flattened by rolling pressure, $\mu$: Frictional coefficient between the sheet in rolling and the rolls, $H$: $2\sqrt{R'/h_2}\tan^{-1}\sqrt{R'/h_2}\,\theta$, and $H_1$: H at the roll bite entry.

Further, Dr. A. J. F. MacQueen has experimentally confirmed the validity of the following equations in the rolling of a metal sheet through rolling mill rolls:

$$P = P_0 - P_T$$
$$P_T = 0.16\,T_F + 0.32\,T_B$$

Where, $P$: Rolling load, $P_0$: Rolling load required when no tension is applied to the sheet in rolling, $T_T$: Amount of decrease in rolling load when tension is applied to the sheet in rolling, $T_F$: Front tension applied to the sheet in rolling (i.e., tension on the roll exit side).

$T_B$: Back tension applied to the sheet in rolling (i.e., tension on the roll entry side).

As is apparent from the above-mentioned equations, when a tension is applied to a sheet in rolling, the same effect is obtained as in the case where the deformation resistance of said sheet in rolling decreases, and accordingly, the rolling force on the rolling mill rolls decreases. When said rolling force on the rolling mill rolls decreases, the thickness of the sheet in rolling is reduced by the elastic deformation of the rolling mill rolls if the mill setting is kept unchanged. It is ascertained that these relations can be applied for the gage control of finished sheets such as thin steel sheets.

Figure 5:
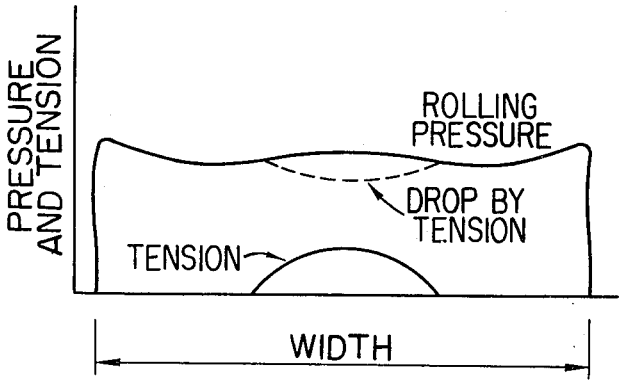
FIG. 5 is a schematic drawing illustrating the effect of the tension applied to a sheet during rolling on the rolling force.

The foregoing is applicable in a case where the tension applied to the sheet in rolling varies in the width direction. When the tension is applied to part of the sheet in rolling in the width direction, as shown in FIG. 5, the same effect is obtained as in the case where the deformation resistance of said part of the sheet in rolling where the tension is applied decreases, and the draft at this part increases. In the current cold tandem mills for a thin steel sheet, a tension is usually applied to the sheet in rolling at the entry and the exit sections of the roll stands. Therefore, an irregular flatness of the sheet in rolling occurring in the preceding roll stands is spontaneously corrected to some extent by the difference in tension in the sheet in rolling spontaneously occurring in the width direction.

As a result of studies conducted with consideration to the above-mentioned known facts, it has been demonstrated that a finished sheet with a defective flatness can be satisfactorily corrected during rolling if said sheet in rolling is positively subjected to a tension which would promote the difference in tension in the width direction spontaneously generated in response to the uneven flatness of said sheet in rolling.

In the present invention, the application of a tension in response to the defective flatness of the sheet in rolling as mentioned above is accomplished by partially giving a vertical displacement to said sheet in the width direction. For example, in the case where a center buckling (see FIG. 1(*a*) to (*d*) occurs in a sheet in rolling, a vertical displacement is given to the side edge portions in the width direction of said sheet, thereby increasing the tension at said portions of said sheet. When a wavy edge (see FIG. 3(*a*) to (*b*)) occurs in a sheet in rolling, a vertical displacement is given to the width center portion of said sheet, thereby increasing the tension at said portion of said sheet.

Now, an embodiment of the apparatus for controlling the flatness of a metal sheet in rolling of the present invention (hereafter referred to as the "flatness control apparatus") is described below in detail with reference to the drawings.

Figure 6:
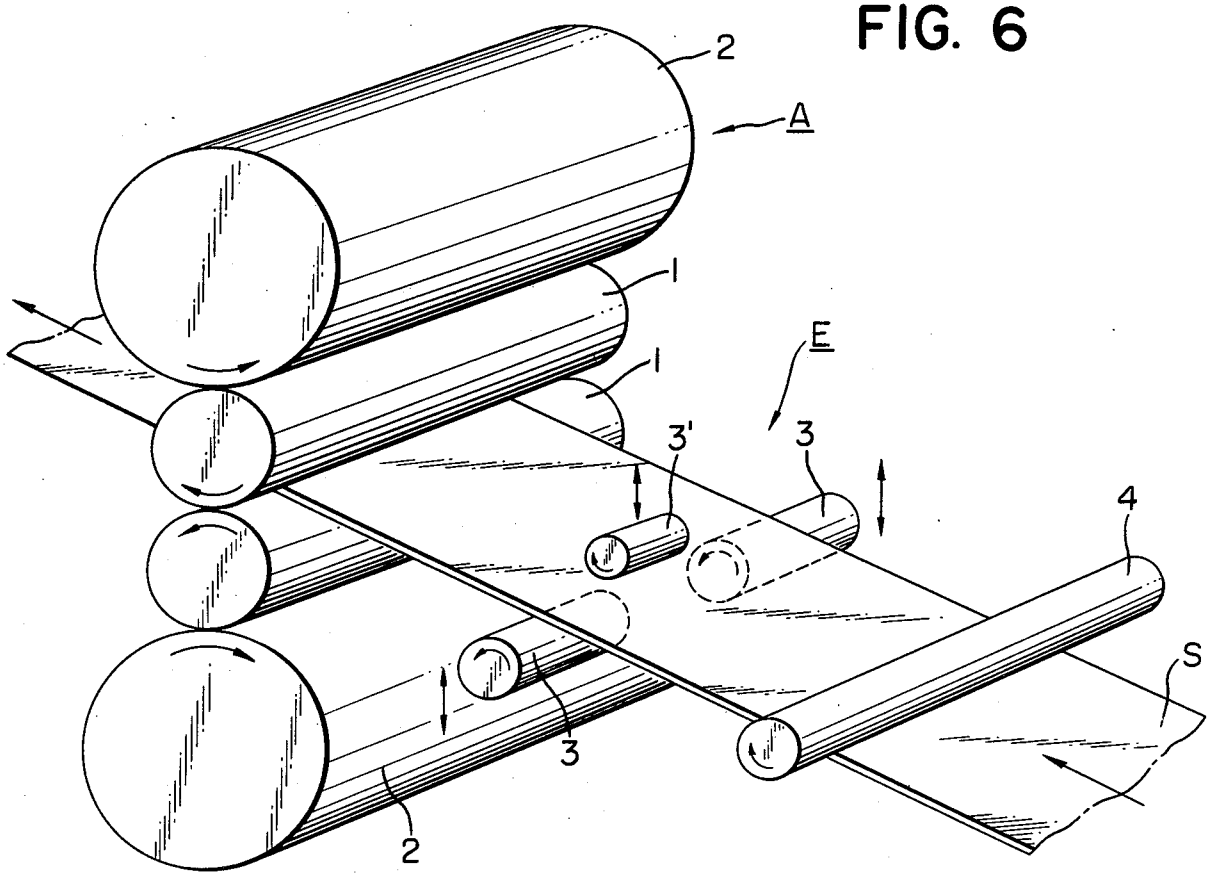
FIGS. 6 and 9 are schematic drawings of an apparatus of the present invention.

The flatness control apparatus E of the present invention shown in the perspective view of FIG. 6 comprises two edge-rollers 3 and 3 a center-roller 3' arranged at the entry section of rolling mill rolls A comprising work rolls 1 and 1 and back-up rolls 2 and 2.

Said edge-rollers 3 are arranged, as shown in FIGS. 6 and 8(*a*), (*b*) and (*c*), symmetrically in the width direction of a sheet S in rolling substantially in the horizontal direction, respectively closely adjacent to the lower surfaces of the side edge portions of said sheet, at the entry section of the rolling mill rolls A. In the case where a center buckling (see FIG. 1(*a*) to (*d*) occurs in said sheet S, said edge-rollers 3 are operated as described later to apply a vertical displacement to the side edge portions of said sheet S, thereby increasing the tension at said portions, and hence rendering the elongation uniform over the width of said sheet S to correct the buckling in said sheet S in rolling.

The manner of operation of the edge-rollers 3 is described with reference to FIG. 8(*a*), (*b*) and (*c*).

In the example of operation shown in FIG. 8(*a*), said edge-rollers 3 are provided closely adjacent to the lower surfaces of the respective side edge portions of said sheet S, with the axial direction thereof being perpendicular to the rolling direction of said sheet S and horizontal. Said rollers 3 are vertically movable as shown by the arrows in the drawing. The tension at the side edge portions of said sheet S in rolling is changed by simply lifting and lowering said rollers 3. Provision of a taper on each of said rollers 3 at the inside end thereof as shown in the drawing eliminates the risk of causing scratches on said sheet S.

In the example of operation shown in FIG. 8(*b*), said edge-rollers 3 are provided closely adjacent to the lower surfaces of the respective side edge portions of said sheet S, with the axial direction thereof being perpendicular to the rolling direction of said sheet S. Said rollers 3 are tiltable, as shown by the arrows in the drawing, clockwise and anti-clockwise and in the vertical direction around the axial center thereof. The tension at the side edge portions of said sheet S in rolling is changed by tilting said rollers 3. Provision of a taper on each of said rollers 3 at the inside end thereof as shown in the drawing eliminates the risk of causing scratches on said sheet S.

In the example of operation shown in FIG. 8(*c*), furthermore, said edge-rollers 3 are provided closely adjacent to the lower surfaces of the respective side edge portions of said sheet S, with the axial direction thereof being perpendicular to the rolling direction of said sheet S and symmetrically at a certain angle of inclination to the horizontal direction. Said rollers 3 are movable perpendicularly to the rolling direction of said sheet S and horizontally, as shown by the arrows in the drawing, while keeping said angle of inclination. The tension at the side edge portions of said sheet S in rolling is changed by moving said rollers 3 perpendicularly to the rolling direction of said sheet S and horizontally.

The edge-rollers 3, which are provided closely adjacent to the lower surfaces of the side edge portions of the sheet S in rolling in the examples mentioned above, may be installed closely adjacent to the upper surfaces of the respective side edge portions of said sheet S, or moreover, plural mechanisms mentioned above may be used in combination in operation.

Said center-roller 3' is provided, as shown in FIGS. 6 and 8(*d*), (*e*) and (*f*), closely adjacent to the upper surface of the width center portion of the sheet S in rolling substantially in the horizontal direction, at the entry section of the rolling mill rolls A, and between the aforementioned edge-rollers 3 and 3. Said center-roller 3' is vertically movable, as shown by the arrows in the drawings. In the case where a wavy edge (see FIG. 3(*a*) to (*d*)) occurs in said sheet S, the tension at the center portion of said sheet S is increased by vertically moving said center roller 3' downward to apply a vertical displacement to the width center portion of said sheet S, thereby achieving a uniform elongation in the width direction of said sheet S and correcting the wavy edge of said sheet S in rolling. Provision of a taper on each of the ends of said center-roller 3', as shown in FIG. 8(*d*) to (*f*), eliminates the risk of causing scratches on said sheet S.

The center-roller 3', which is provided closely adjacent to the upper surface of the sheet S in rolling in the above-mentioned example, may of course be installed closely adjacent to the lower surface of said sheet S.

When simultaneously controlling a center buckling and a wavy edge, one has only to operate simultaneously in the aforementioned manner said edge-rollers 3 and said center-roller 3', as shown in FIG. 8(*d*), (*e*) and (*f*).

In the present invention, an auxiliary-roller 4 may be employed, as shown in FIG. 6, for the purpose of effectively changing the tension distribution in the width direction of the sheet S in rolling with a slight amount of displacement, in giving a vertical displacement to part of said sheet S with the use of the above-mentioned edge-rollers 3 and center-roller 3'. Said auxiliary-roller 4 is located at a position more distant from the rolling mill rolls A than said edge-rollers 3 and said center-roller 3', and in contact with at least one of the upper and the lower surfaces of said sheet S throughout the entire width thereof. The axial direction of said auxiliary-roller is perpendicular to the rolling direction of said sheet and horizontal. Said auxiliary-roller 4 is not limited to a flat roller, but may be any of rollers with various crowns. When the displacement applying point to said sheet S is sufficiently close to the rolling mill rolls A, it is not necessary to provide said auxiliary-roller 4.

Figure 7:
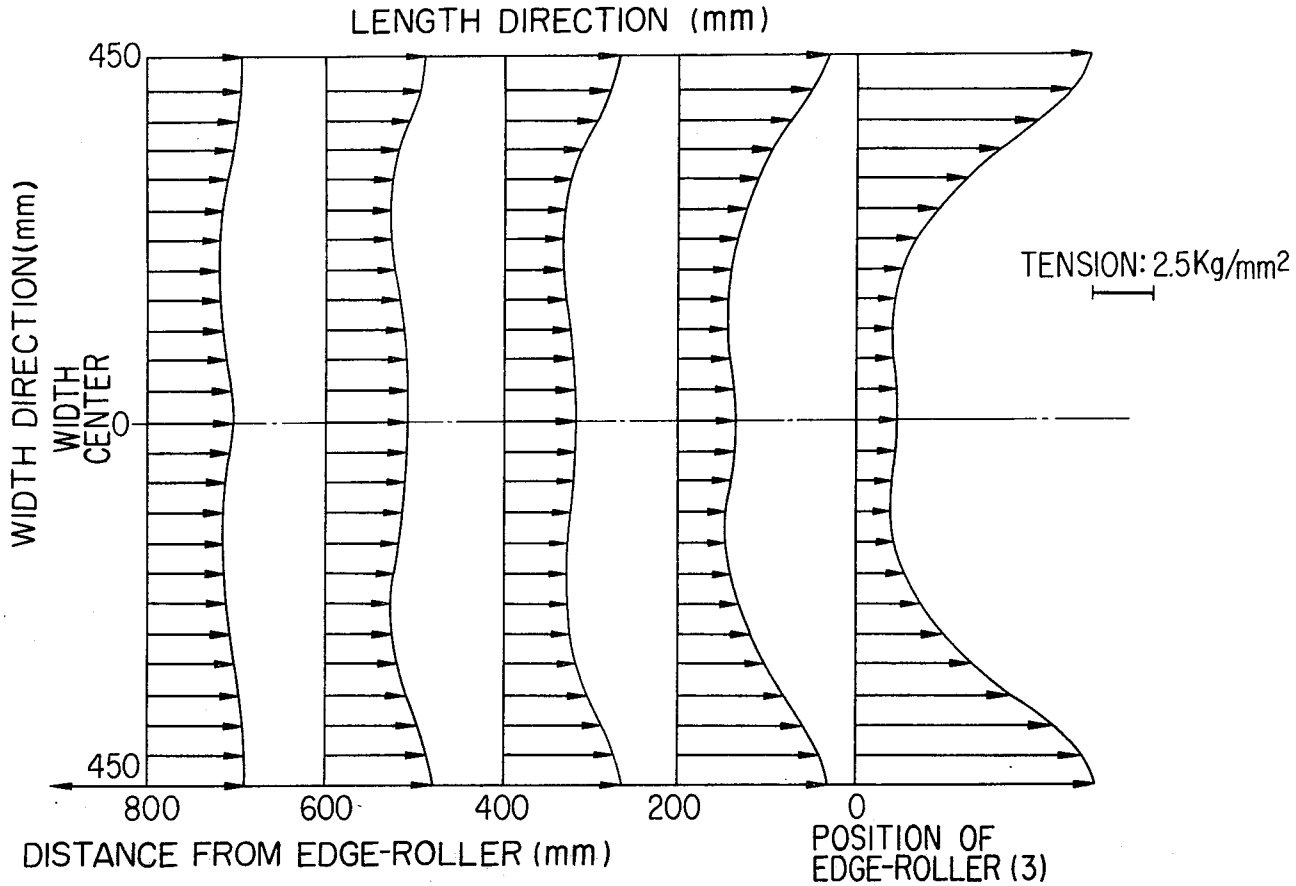
FIG. 7 is a drawing illustrating the tension distribution of a steel sheet in the width direction in the case where a vertical displacement is applied to the side edge portions of said steel sheet.
Figure 8A:
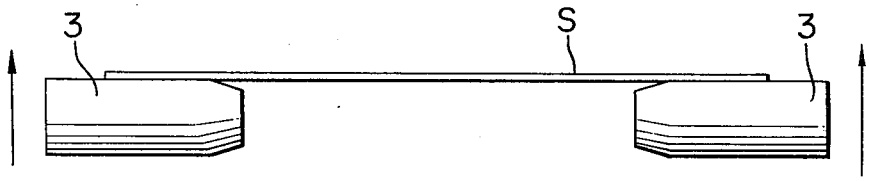
FIGS. 8(*a*)–8(*f*) are schematic drawings illustrating the actuation of edge-rollers and a center-roller in accordance with the present invention.
Figure 8B:
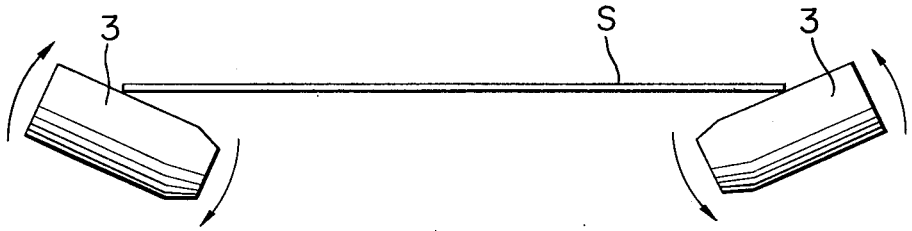
Figure 8C:
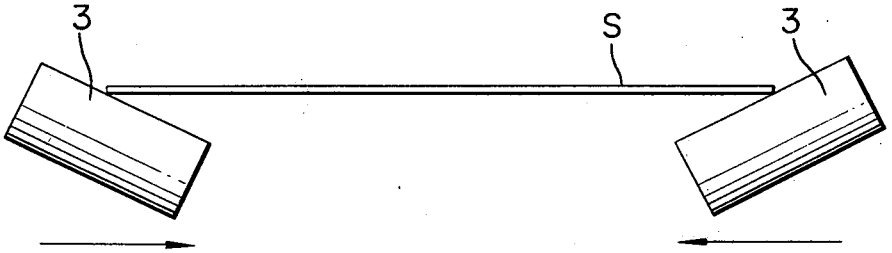
Figure 8D:
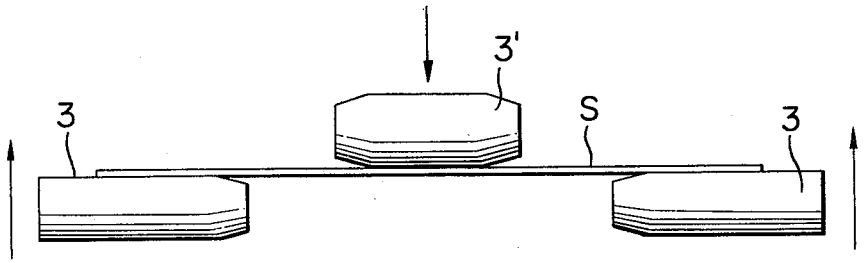
Figure 8E:
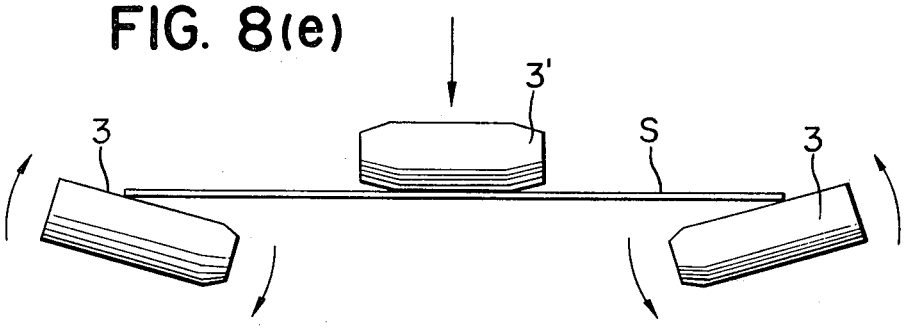
Figure 8F:
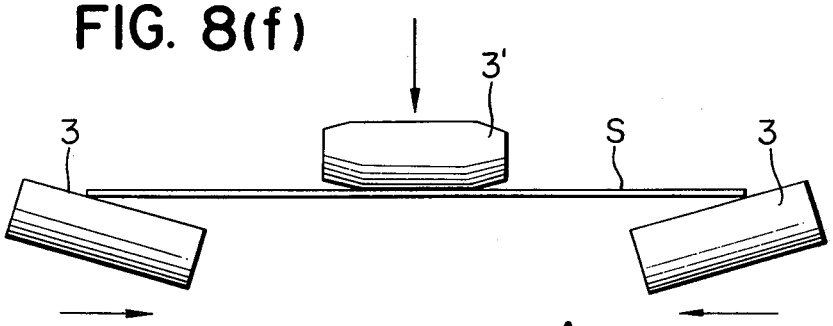

FIG. 7 illustrates the tension distribution before rolling in the width direction produced in a thin steel sheet having a thickness of 0.5 mm and a width of 900 mm when a vertical displacement of 5 mm is given to the side edge portions of said sheet with the use of said edge-rollers 3. As is clear from FIG. 7, a tension of about 10 kg/mm$^2$ is produced at the side edge portions of said sheet applied with a load by said edge-rollers 3. This tension sharply decreases toward the width center of said sheet, and there is a large difference in tension between the center and the edges in the width direction of said sheet. This difference in tension becomes smaller at a longer distance in the length direction of said sheet from the load applying point, i.e., said edge-rollers 3. According to FIG. 7, the tension distribution is almost uniform in the width direction at a distance of 800 mm from said edge-rollers 3, with almost no difference in tension.

Therefore, in order to achieve an effective change in the tension distribution in the width direction of a sheet in rolling at a location where rolling mill rolls are rolling said sheet (i.e., at the roll bite), said edge-rollers 3 and said center-roller 3' should be installed at a distance not exceeding 800 mm.

Figure 9:
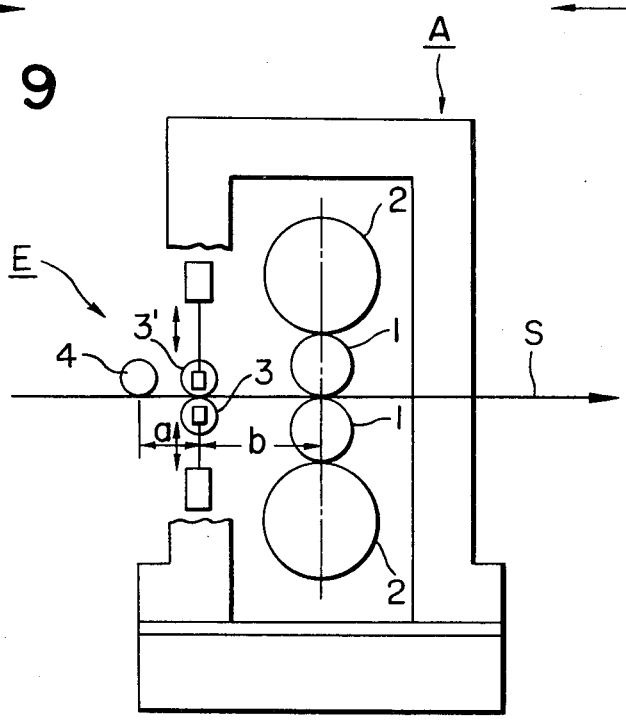

The flatness control apparatus of the present invention is described more in detail with reference to FIG. 9. In FIG. 9, the edge-rollers 3 and the center-roller 3' are arranged, at the entry section of the rolling mill rolls A comprising the work rolls 1 and the back-up rolls 2, at a distance of 400 mm (as indicated by *b* in the drawing) from the center of said mill rolls A. Said edge-rollers 3 are provided closely adjacent to the lower surfaces of the respective side edge portions of the sheet S in rolling substantially in the horizontal direction, and said center-roller 3' is provided closely adjacent to the upper surface of the width center portion of said sheet S. The auxiliary-roller 4 is arranged, at the entry section of said mill rolls A, at a distance of 300 mm (as indicated by *a* in the drawing) from the center of said edge-rollers 3 and said center-roller 3', opposite to said mill rolls A. Said auxiliary-roller 4 is provided in contact with the upper surface of said sheet S throughout the entire width thereof.

In FIG. 9, said edge-rollers 3 and said center-roller 3' have a diameter of 150 mm in all cases, and are movable in the manner as shown by the arrows in the drawing by a hydraulic, motor, pneumatic or any other appropriate drive (not shown). A distance of 10 mm to 20 mm for the displacement of said edge-rollers 3 and said center roller 3' usually suffice, but a space is provided so as to permit a maximum displacement of 50 mm. Said distance of displacement is determined by the direct measurement of the amount of fed working oil or the differential transformer of said drive. Said edge-rollers 3 and said center-roller 3', which are of the hollow construction to permit rotation at a speed synchronized with the forward speed of the sheet S in rolling, may be driven by the drive so as to avoid slips.

In the present invention, furthermore, it is possible to control the flatness of a metal sheet in rolling very rapidly and automatically, by providing a flatness detector (not shown) at a desired location at the exit section of the rolling mill rolls, detecting a defective flatness of said sheet in rolling with the use of said detector, converting the result of detection into a defect signal, and feeding back said defect signal to the edge-rollers and/or the center roller mentioned above, thereby operating said rollers. In the case where a sheet is rolled at a speed of 10 m/sec, for example, it is possible to correct a defective flatness of the sheet in rolling within one second.

The flatness control apparatus E and the auxiliary-roller 4 of the present invention, which are installed at the entry section of the rolling mill rolls A, in the above-mentioned examples, may be installed at the exit section of said mill rolls A, or may be installed both at the entry and the exit sections of said mill rolls A.

According to the present invention, as described above in detail, it is possible to correct a defective flatness of a sheet in rolling at a high response speed with the use of a practical apparatus with a relatively simple design, and thus to largely contribute to the improvement of the quality of finished sheets. The flatness control apparatus of the present invention is applicable not only in the cold rolling, but also in the hot rolling, leveller and skinpass rolling, thus providing industrially useful effects.

What is claimed is:

1. An apparatus for controlling the flatness of a metal sheet during rolling, comprising:

two edge-rollers provided at least at one of the entry and the exit sections of rolling mill rolls, said edge-rollers being located symmetrically in the width direction of a metal sheet during rolling substantially in the horizontal direction, respectively closely adjacent to and facing one of the upper and the lower surfaces of said metal sheet at the side edge portions thereof, the axial direction of said edge-rollers being perpendicular to the rolling direction of said metal sheet, and said edge-rollers causing a change in the tension distribution in the width direction of said metal sheet, by imparting a desired vertical displacement to the side edge portions of said metal sheet, thereby increasing the draft at said side edge portions of said metal sheet during rolling; and a center-roller provided at least at one of the entry and the exit sections of said rolling mill rolls, said center-roller being located between said two edge-rollers, closely adjacent to and facing the other of the upper and the lower surfaces of said metal sheet which is opposite to said one surface which is closely adjacent to and facing said edge-rollers, said center-roller being located at the width center portion of said metal sheet, the axial direction of said center-roller being perpendicular to the rolling direction of said metal sheet and horizontal, said center-roller being vertically movable, and said center-roller causing a change in the tension distribution in the width direction of said metal sheet, by imparting a desired vertical displacement to the width center portion of said metal sheet, thereby increasing the draft at said width center portion of said metal sheet during rolling.

2. The apparatus of claim 1, wherein the axial direction of said edge-rollers is horizontal, and said edge-rollers are vertically movable, thereby imparting a desired displacement to said metal sheet.

3. The apparatus of claim 2, wherein an auxiliary-roller is provided at least at one of the entry and the exit sections of said rolling mill rolls, said auxiliary-roller being located at a position more distant from said rolling mill rolls than said edge-rollers and said center-roller, said auxiliary-roller being in contact with at least one of the upper and the lower surfaces of said metal sheet throughout the entire width thereof, and the axial direction of said auxiliary-roller being perpendicular to the rolling direction of said metal sheet and horizontal.

4. The appatatus of claim 3, wherein said auxiliary roller is passively rotated by its frictional contact with said metal sheet.

5. The apparatus of claim 1, wherein said edge-rollers are tiltable clockwise and counterclockwise and in the vertical direction around the axial center thereof, thereby imparting a desired displacement to said metal sheet.

6. The apparatus of claim 5, wherein an auxiliary-roller is provided at least at one of the entry and the exit sections of said rolling mill rolls, said auxiliary-roller being located at a position more distant from said rolling mill rolls than said edge-rollers and said center-roller, said auxiliary-roller being in contact with at least one of the upper and the lower surfaces of said metal sheet throughout the entire width thereof, and the axial direction of said auxiliary-roller being perpendicular to the rolling direction of said metal sheet and horizontal.

7. The apparatus of claim 6, wherein said auxiliary roller is passively rotated by its frictional contact with said metal sheet.

8. The apparatus of claim 1, wherein the axial direction of said edge-rollers is symmetrically at a given angle of inclination to the horizontal direction, and said edge-rollers are movable perpendicularly to the rolling direction of said metal sheet and horizontally, with said given angle of inclination maintained, thereby imparting a desired displacement to said metal sheet.

9. The apparatus of claim 8, wherein an auxiliary-roller is provided at least at one of the entry and the exit sections of said rolling mill rolls, said auxiliary-roller being located at a position more distant from said rolling mill rolls than said edge-rollers and said center-roller, said auxiliary-roller being in contact with at least one of the upper and the lower surfaces of said metal sheet throughout the entire width thereof, and the axial direction of said auxiliary-roller being perpendicular to the rolling direction of said metal sheet and horizontal.

10. The apparatus of claim 9, wherein said auxiliary roller is passively rotated by its frictional contact with said metal sheet.

11. The apparatus of claim 1, wherein an auxiliary-roller is provided at least at one of the entry and the exit sections of said rolling mill rolls, said auxiliary-roller being located at a position more distant from said rolling mill rolls than said edge-rollers and said center-roller, said auxiliary-roller being in contact with at least one of the upper and the lower surfaces of said metal sheet throughout the entire width thereof, and the axial direction of said auxiliary-roller being perpendicular to the rolling direction of said metal sheet and horizontal.

12. The apparatus of claim 11, wherein said auxiliary roller is passively rotated by its frictional contact with said metal sheet.

13. An apparatus for controlling the flatness of a metal sheet during rolling comprising:

two edge-rollers provided at least at one of the entry and the exit sections of rolling mill rolls, said edge-rollers being located symmetrically in the width direction of a metal sheet during rolling substantially in the horizontal direction, respectively closely adjacent to and facing at least one of the upper and the lower surfaces of said metal sheet at the side edge portions thereof, the axial direction of said edge-rollers being perpendicular to the rolling direction of said metal sheet, and said edge-rollers causing a change in the tension distribution in the width direction of said metal sheet, said edge-rollers being tiltable clockwise and counterclockwise and in the vertical direction around the axial center thereof for imparting a desired vertical displacement to the side edge portions of said metal sheet, thereby increasing the draft at said side edge portions of said metal sheet during rolling; and a center-roller provided at least at one of the entry and the exit sections of said rolling mill rolls, said center-roller being located between said two edge-rollers, closely adjacent to and facing at least one of the upper and the lower surfaces of said metal sheet at the width center portion of said metal sheet, the axial direction of said center-roller being perpendicular to the rolling direction of said metal sheet and horizontal, said center-roller being vertically movable, and said center-roller causing a change in the tension distribution in the width direction of said metal sheet, by imparting a desired vertical displacement to the width center portion of said metal sheet, thereby increasing the draft at said width center portion of said metal sheet during rolling.

14. The apparatus of claim 13, wherein an auxiliary-roller is provided at least at one of the entry and the exit sections of said rolling mill rolls, said auxiliary-roller being located at a position more distant from said rolling mill rolls than said edge-rollers and said center-roller, said auxiliary-roller being in contact with at least one of the upper and the lower surfaces of said metal sheet throughout the entire width thereof, and the axial direction of said auxiliary-roller being perpendicular to the rolling direction of said metal sheet and horizontal.

15. The apparatus of claim 14, wherein said auxiliary roller is passively rotated by its frictional contact with said metal sheet.

16. An apparatus for controlling the flatness of a metal sheet during rolling, comprising:

two edge-rollers provided at least at one of the entry and the exit sections of rolling mill rolls, said edge-rollers being located symmetrically in the width direction of a metal sheet during rolling substantially in the horizontal direction, respectively closely adjacent to and facing one of the upper and the lower surfaces of said metal sheet at the side edge portions thereof, the axial direction of said edge-rollers being perpendicular to the rolling direction of said metal sheet and symmetrically at a given angle of inclination to the horizontal direction, and said edge-rollers causing a change in the tension distribution in the width direction of said metal sheet, said edge-rollers being movable perpendicularly to the rolling direction of said metal sheet and horizontally with said given angle of inclination maintained for imparting a desired vertical displacement to the side edge portions of said metal sheet, thereby increasing the draft at said side edge portions of said metal sheet during rolling; and a center-roller provided at least at one of the entry and the exit sections of said rolling mill rolls, said center-roller being located between said two edge-rollers, closely adjacent to and facing at least one of the upper and the lower surfaces of said metal sheet at the width center portion of said metal sheet, the axial direction of said center-roller being perpendicular to the rolling direction of said metal sheet and horizontal, said center-roller being vertically movable, and said center-roller causing a change in the tension distribution in the width direction of said metal sheet, by imparting a desired vertical displacement to the width center portion of said metal sheet, thereby increasing the draft at said width center portion of said metal sheet during rolling.

17. The apparatus of claim 16, wherein an auxiliary-roller is provided at least at one of the entry and the exit sections of said rolling mill rolls, said auxiliary-roller being located at a position more distant from said rolling mill rolls than said edge-rollers and said center-roller, said auxiliary-roller being in contact with at least one of the upper and the lower surfaces of said metal sheet throughout the entire width thereof, and the axial direction of said auxiliary-roller being perpendicular to the rolling direction of said metal sheet and horizontal.

18. The apparatus of claim 17, wherein said auxiliary roller is passively rotated by its frictional contact with said metal sheet.

* * * * *

UNITED STATES PATENT AND TRADEMARK OFFICE

CERTIFICATE OF CORRECTION

PATENT NO. : 4,033,165

DATED : July 5, 1977

INVENTOR(S) : Toru ARIMURA, et al

It is certified that error appears in the above-identified patent and that said Letters Patent are hereby corrected as shown below:

On the initial page of the patent, under the heading [73] Assignee, add the following additional Assignee company:

--ISHIKAWAJIMA-HARIMA JUKOGYO KABUSHIKI KAISHA
Tokyo, Japan--.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*